US009248581B2

(12) United States Patent
Misumi et al.

(10) Patent No.: US 9,248,581 B2
(45) Date of Patent: Feb. 2, 2016

(54) POST-PROCESSING DEVICE, AND IMAGE FORMING APPARATUS

(71) Applicant: FUJI XEROX CO., LTD., Tokyo (JP)

(72) Inventors: Hajime Misumi, Kanagawa (JP); Hyonju Kim, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 60 days.

(21) Appl. No.: 14/174,395

(22) Filed: Feb. 6, 2014

(65) Prior Publication Data

US 2015/0048137 A1 Feb. 19, 2015

(30) Foreign Application Priority Data

Aug. 15, 2013 (JP) ..... 2013-168780

(51) Int. Cl.

| | |
|---|---|
| ***B27F 7/36*** | (2006.01) |
| ***B42C 1/10*** | (2006.01) |
| ***B65H 37/04*** | (2006.01) |
| ***B31F 5/00*** | (2006.01) |
| ***B42B 4/00*** | (2006.01) |
| ***B42C 1/12*** | (2006.01) |

(52) U.S. Cl.

CPC . *B27F 7/36* (2013.01); *B31F 5/001* (2013.01); *B42B 4/00* (2013.01); *B42C 1/10* (2013.01); *B42C 1/12* (2013.01); *B65H 37/04* (2013.01); *B65H 2801/27* (2013.01)

(58) Field of Classification Search

CPC ..... B27F 7/36; B42C 1/00; B42C 1/12; B65H 37/04; B65H 2801/27; B31F 5/001

USPC ..... 270/58.02, 58.08, 58.09; 227/19

See application file for complete search history.

(56) References Cited

U.S. PATENT DOCUMENTS

| | | | | |
|---|---|---|---|---|
| 8,371,393 | B2 * | 2/2013 | Higuchi et al. | 173/1 |
| 2012/0082497 | A1 * | 4/2012 | Nagasaki | 399/410 |
| 2014/0239571 | A1 * | 8/2014 | Kakutani et al. | 270/58.09 |

FOREIGN PATENT DOCUMENTS

| | | |
|---|---|---|
| JP | A-6-115276 | 4/1994 |
| JP | A-2005-104684 | 4/2005 |

* cited by examiner

*Primary Examiner* — Leslie A Nicholson, III
(74) *Attorney, Agent, or Firm* — Oliff PLC

(57) ABSTRACT

Provided is a post-processing device including a stapling unit that performs stapling on a sheet bundle with a driving force caused by a rotation of a motor, a power supply unit that supplies power only to the motor, a sheet bundle detector that detects presence or absence of the sheet bundle which is inserted into the stapling unit, and a stapling time storage unit that stores an execution time of one session of the stapling, wherein the power supply unit initiates power supply to the motor based on a detection result of the sheet bundle detector and stops supplying the power to the motor after an elapse of a predetermined time which is stored in the stapling time storage unit.

6 Claims, 11 Drawing Sheets

POST-PROCESSING DEVICE, AND IMAGE FORMING APPARATUS

CROSS-REFERENCE TO RELATED APPLICATIONS

This application is based on and claims priority under 35 USC 119 from Japanese Patent Application No. 2013-168780 filed Aug. 15, 2013.

BACKGROUND

Technical Field

The present invention relates to a post-processing device, and an image forming apparatus.

SUMMARY

According to an aspect of the invention, there is provided a post-processing device including:

a stapling unit that performs stapling on a sheet bundle with a driving force caused by a rotation of a motor;

a power supply unit that supplies power only to the motor;

a sheet bundle detector that detects presence or absence of the sheet bundle which is inserted into the stapling unit; and a stapling time storage unit that stores an execution time of one session of the stapling, wherein the power supply unit initiates power supply to the motor based on a detection result of the sheet bundle detector and stops supplying the power to the motor after an elapse of a predetermined time which is stored in the stapling time storage unit.

BRIEF DESCRIPTION OF THE DRAWINGS

Exemplary embodiments of the present invention will be described in detail based on the following figures, wherein.

DETAILED DESCRIPTION

Figure 1:
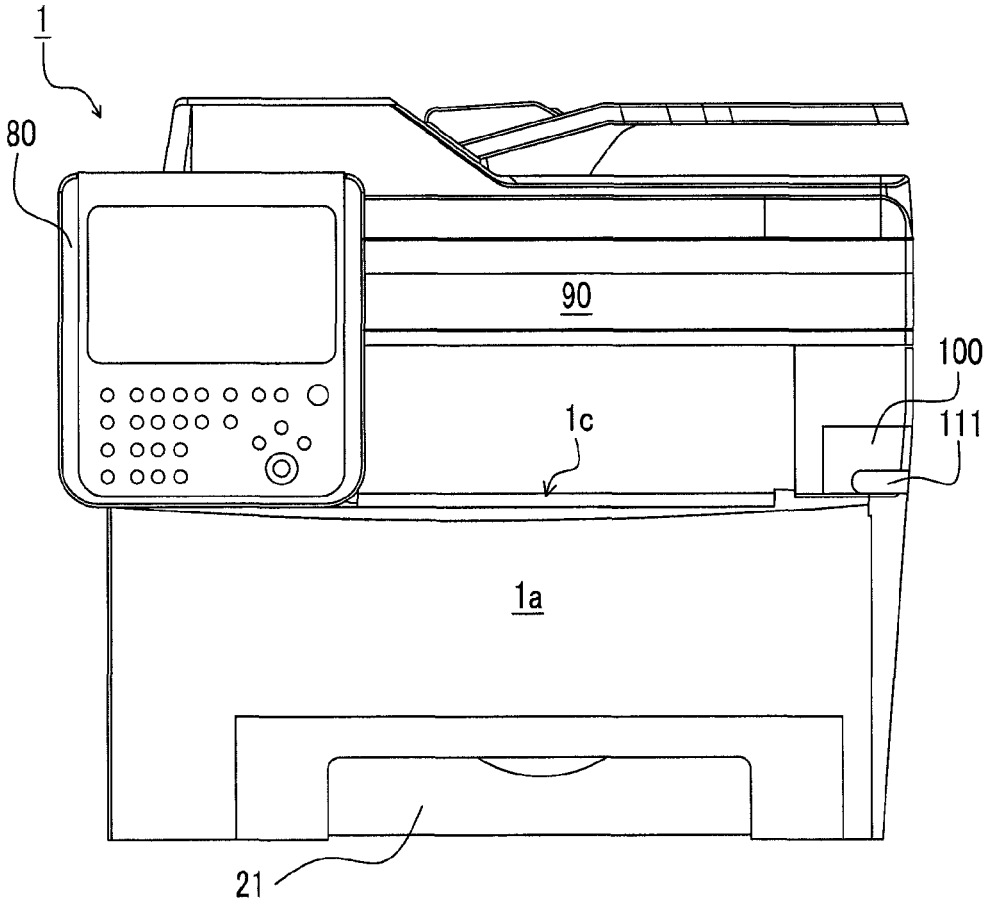
FIG. 1 is a front exterior view of an image forming apparatus.

Hereinafter, exemplary embodiments of the present invention will be described in further detail referring to the accompanying drawings. However, the present invention is not limited to the exemplary embodiments.

In the following description referring to the drawings, it should be noted that the drawings are schematic and dimensional proportions and the like are different from their actual values. Illustrations of members other than those which are necessary in description are suitably omitted for ease of understanding.

First Exemplary Embodiment

(1) Configuration of Image Forming Apparatus

Figure 2:
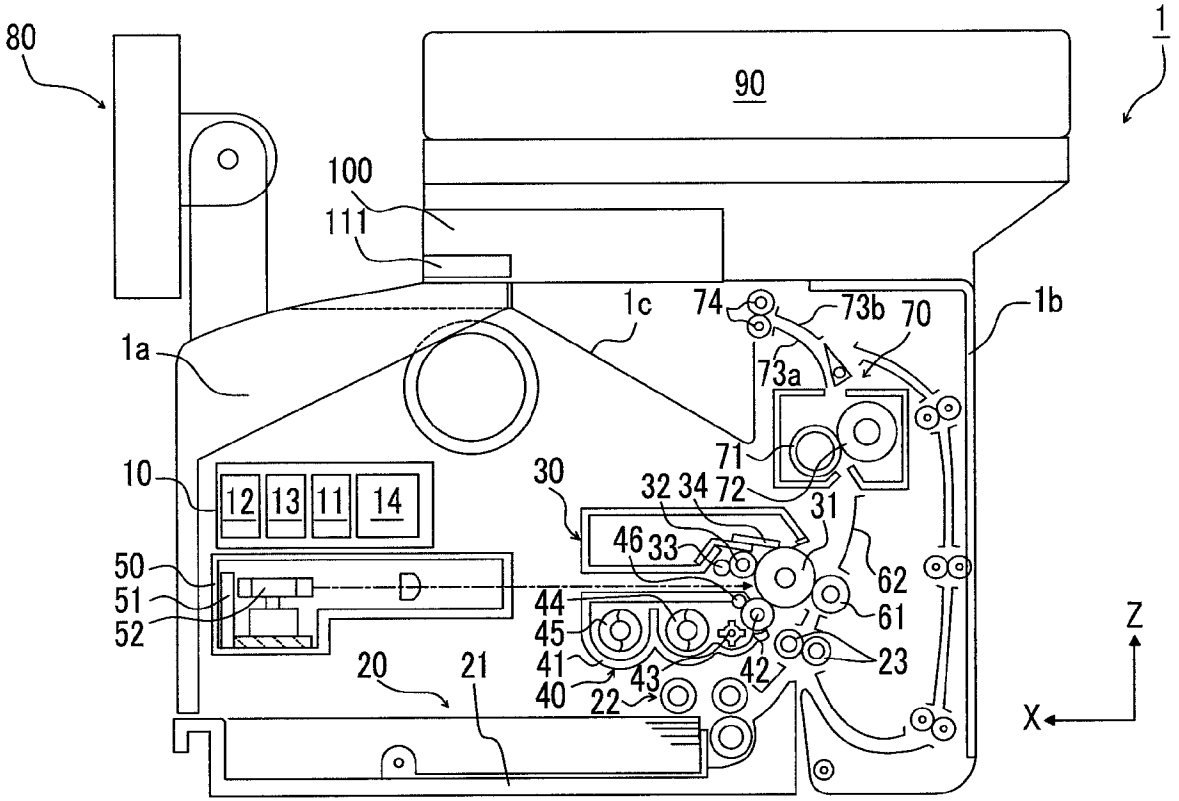
FIG. 2 is a cross-sectional schematic diagram showing an internal configuration of the image forming apparatus.

FIG. 1 is a front exterior view of an image forming apparatus 1 according to this exemplary embodiment, and FIG. 2 is a cross-sectional schematic diagram showing an internal configuration thereof.

Hereinafter, an overall configuration and operation of the image forming apparatus 1 will be described referring to the accompanying drawings.

(1. 1) System Configuration of Image Forming Apparatus

The image forming apparatus 1 is configured to include a control device 10, a sheet feeding device 20, a photoconductor unit 30, a developing device 40, an exposure device 50, a transfer device 60, a fixing device 70, an operation unit 80, an image reading device 90, and a stapling device 100.

A front cover 1*a* is rotatably supported on a front surface of the image forming apparatus 1 so that an inner section of the image forming apparatus 1 is opened forward (X direction) in a case where consumables or the like are replaced.

A rear cover 1*b* is rotatably supported on a rear surface of the image forming apparatus 1 so that the inner section of the image forming apparatus 1 is opened in a case where paper jams, an internal inspection is performed, or the like.

An output tray 1*c* is formed on an upper surface (Z direction) of the image forming apparatus 1 so that an image-recorded sheet is discharged or accommodated.

The control device 10 has an image forming apparatus control unit 11 that controls the operation of the image forming apparatus 1, a controller unit 12 that prepares image data according to a print processing request, an exposure control unit 13 that controls lighting of a light source of the exposure device 50, a power supply device 14, and the like. The power supply device 14 applies voltage to a charging roller 32, a developing roller 42, a transfer roller 61 and the like, which are to be described later, and supplies power to the exposure device 50.

The controller unit 12 converts the image data that is input from the image reading device 90 and prints information that is input from an external information transmission device (for example, a personal computer) to image information for latent image formation, and outputs a drive signal to the exposure control unit 13 at a predetermined timing.

The operation unit 80 is used to input various settings and instructions and display information. In other words, the operation unit 80 corresponds to a so-called user interface and, specifically, is configured by combining a liquid crystal display panel, various operation buttons, a touch panel and the like.

(1. 2) Configuration and Operation of Image Forming Unit

The sheet feeding device 20 is disposed in a bottom section of the image forming apparatus 1. The sheet feeding device 20 has a sheet cassette 21 that accommodates a sheet as a recording medium, and multiple sheets are stacked on an upper surface of the sheet cassette 21. The sheets that are stacked on the sheet cassette 21 and are positioned in a width direction by a regulating plate (not shown) are drawn sheet by sheet from an upper side by a sheet drawer unit 22, and then are transported to a nip section of a registration roller pair 23.

The photoconductor unit 30 is disposed above the sheet feeding device 20, and has a photoconductor drum 31 that is driven to rotate. The charging roller 32, the developing device 40, the transfer roller 61, and a cleaning blade 34 are placed along a direction of rotation of the photoconductor drum 31. A cleaning roller 33 that cleans an outer surface of the charging roller 32 is placed to face and be in contact with the charging roller 32.

The developing device 40 has a developing housing 41 in which a developer is accommodated. The developing roller 42 that is placed to face the photoconductor drum 31 is placed in the developing housing 41, and a paddle wheel 43 that agitates and transports the developer to the developing roller 42 side is placed on an obliquely downward back surface side from the developing roller 42. Further, a pair of agitating and transporting augers 44 and 45 are arranged on a back surface side from the paddle wheel 43. A layer regulating roll 46 that regulates a layer thickness of the developer is placed close to the developing roller 42.

The exposure device 50 has a laser beam emitter 51 that is used as the light source and a rotating polygon mirror (polygon mirror) 52 that deflects a laser beam LB from the laser beam emitter 51, and an outer surface of the photoconductor drum 31 is scanned with the laser beam LB modulated according to the image data which is formed.

The outer surface of the rotating photoconductor drum 31 is charged by the charging roller 32, and an electrostatic latent image is formed by the laser beam LB which is emitted from the exposure device 50. The electrostatic latent image that is formed on the photoconductor drum 31 is developed as a toner image by the developing roller 42.

The transfer device 60 is configured to have the rear cover 1*b* that supports the transfer roller 61 to be separable from the photoconductor drum 31, and the transfer roller 61 that forms a nip with the photoconductor drum 31. Transfer voltage is applied from the power supply device 14 controlled by the image forming apparatus control unit 11 to the transfer roller 61, and the toner image on the photoconductor drum 31 is transferred to the sheet passing between the photoconductor drum 31 and the transfer roller 61.

Residual toner on the outer surface of the photoconductor drum 31 is removed by the cleaning blade 34, and is collected into a housing that supports the photoconductor drum 31. Then, the outer surface of the photoconductor drum 31 is re-charged by the charging roller 32. Residue that is not removed by the cleaning blade 34 but is attached to the charging roller 32 is captured and accumulated on an outer surface of the cleaning roller 33 which rotates in contact with the charging roller 32.

The fixing device 70 has a pair of fixing rollers 71 and 72, and a fixing area is formed by a pressure welding area of the pair of fixing rollers 71 and 72.

The sheet to which the toner image is transferred by the transfer roller 61 is transported through a transport guide 62 to the fixing device 70 in a state where the toner image is not fixed. On the sheet that is transported to the fixing device 70, the toner image is fixed through crimping and heating operations by the pair of fixing rollers 71 and 72. The sheet on which the fixed toner image is formed is guided by transport guides 73*a* and 73*b* and is discharged to the output tray 1*c* on the upper surface of the image forming apparatus 1 from a discharge roller pair 74.

The stapling device 100 as an example of a stapling unit is disposed inside a leg section of the image reading device 90, and stapling is performed on an image-read original document bundle and a sheet bundle PB on which an after-print image is recorded.

(2) Block Configuration and Operation of Stapling Device 100

Figure 3A:
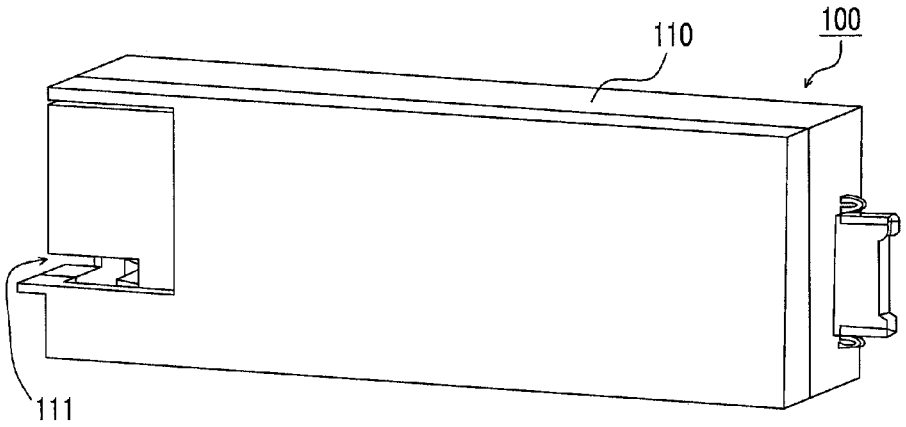
FIG. 3A is a perspective diagram showing an exterior of a stapling device provided inside a leg section of an image reading device.
Figure 3B:
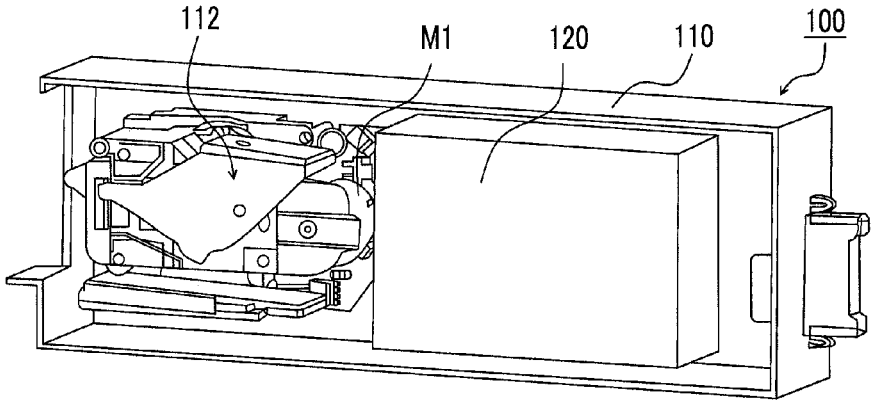
FIG. 3B is a perspective diagram showing an internal configuration thereof.
Figure 4:
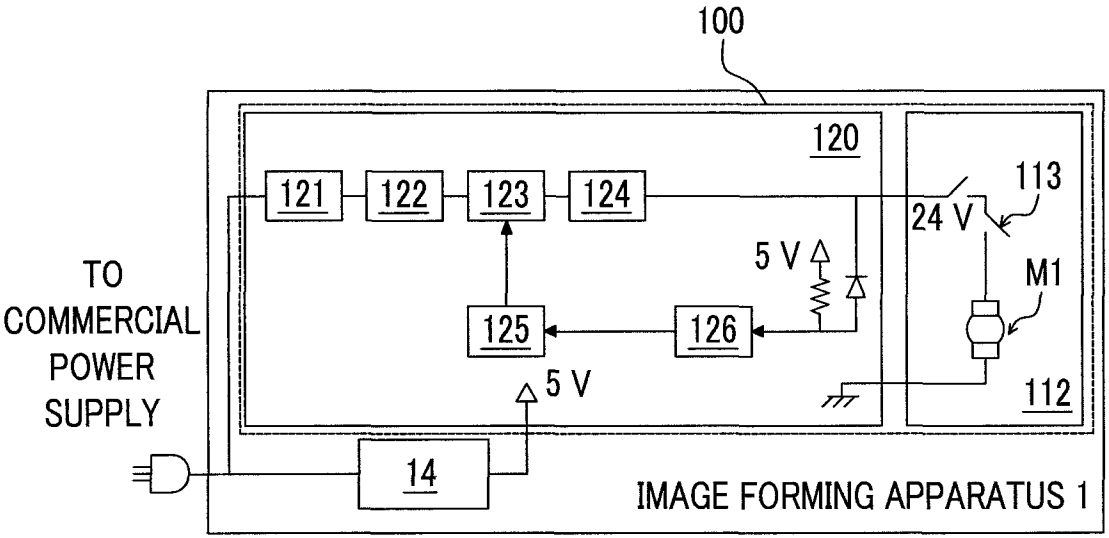
FIG. 4 is a block diagram of the stapling device that has a second power supply according to a first exemplary embodiment.
Figure 5:
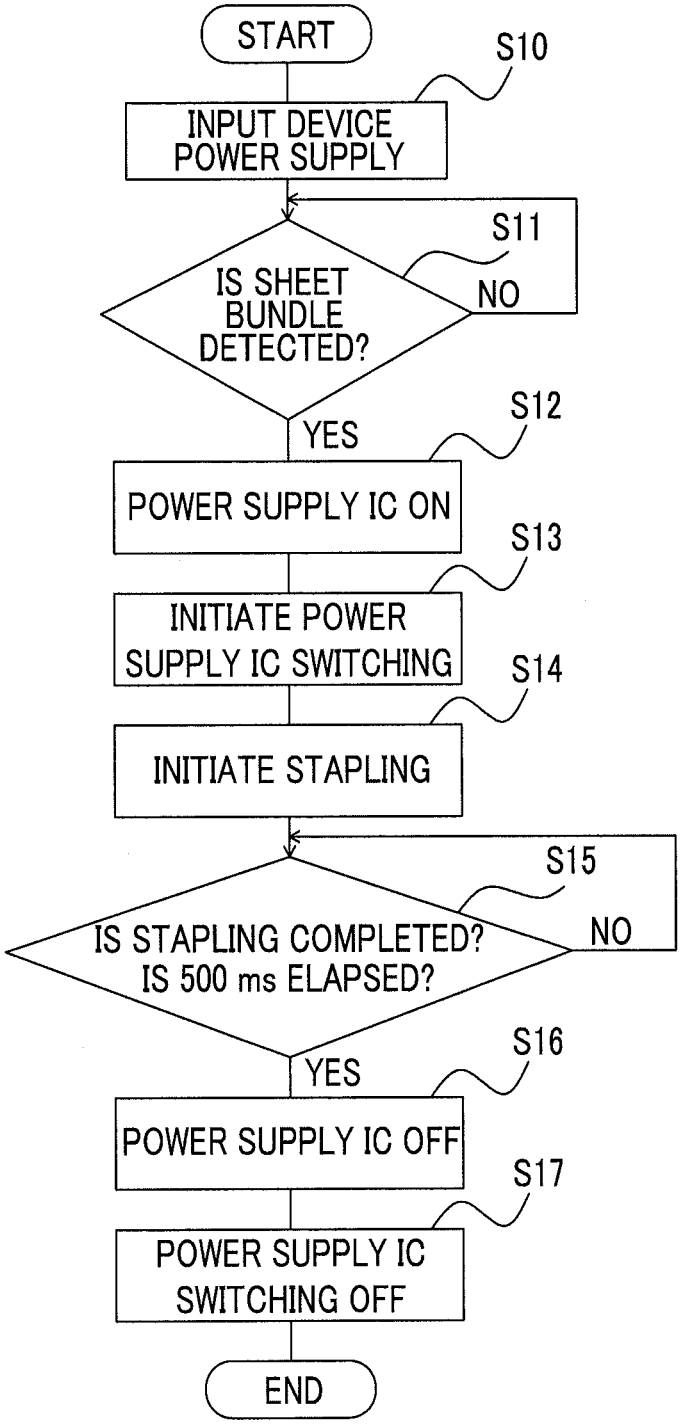
FIG. 5 is a flowchart showing a flow of operation of stapling of the stapling device according to the first exemplary embodiment.

FIG. 3A is a perspective diagram showing an exterior of the stapling device 100 provided inside the leg section of the image reading device 90, and FIG. 3B is a perspective diagram showing an internal configuration thereof. FIG. 4 is a block diagram of the stapling device 100 that has a second power supply 120. FIG. 5 is a flowchart showing a flow of operation during the stapling (stapling) of the stapling device 100. Hereinafter, the block configuration and operation of the stapling device 100 will be described referring to the accompanying drawings.

As shown in FIGS. 3A and 3B, the stapling device 100 is disposed with a sheet bundle insertion unit 111 in a front side corner section of a housing 110, and is configured to have a stapling unit 112 that performs the stapling on the sheet bundle PB which is inserted into the sheet bundle insertion unit 111, a sheet bundle sensor 113 (not shown in FIGS. 3A and 3B, refer to FIG. 4) as an example of a sheet bundle detector that detects the presence and absence of the sheet bundle PB inserted into the sheet bundle insertion unit 111, and the dedicated second power supply 120 as an example of a power supply unit that supplies power to a drive motor M1 of the stapling unit 112.

As shown in FIG. 4, the second power supply 120 is configured to have a filter 121, a primary side smoothing circuit 122, a step-up transformer 123, a secondary side smoothing circuit 124, a power supply IC 125, and a sheet bundle detection circuit 126.

A not-shown commercial power supply is connected to the second power supply 120, operation control is performed by the image forming apparatus control unit 11 with 5 V reference voltage supplied from the power supply device 14 of the image forming apparatus 1, and the drive motor M1 of the stapling unit 112 is driven.

In a state where the power supply device 14 of the image forming apparatus 1 is input (S10) and in a case where the sheet bundle PB is inserted into the sheet bundle insertion unit 111 and the sheet bundle sensor 113 is ON (sheet bundle is present) (S11: Yes), switching of the step-up transformer 123 is initiated (S13) in the second power supply 120 as the sheet bundle detection circuit 126 turns ON the power supply IC 125 (S12) which is a switching element.

When the switching of the step-up transformer 123 is initiated by the power supply IC 125, an alternating current boosted by the step-up transformer 123 is output to the drive motor M1 via the secondary side smoothing circuit 124 as 24 V which is drive voltage, and stapling is performed on the sheet bundle PB (S14).

Then, the power supply IC 125 is turned OFF (S16) at a point of time (S15: Yes) when execution time (for example, 500 ms) of one session of stapling stored in a stapling time storage unit elapses and the stapling is completed, and the switching of the step-up transformer 123 by the power supply IC 125 is stopped (S17).

(3) Operation and Effect of Stapling Device 100

The image forming apparatus 1 according to this exemplary embodiment includes the stapling device 100 that performs stapling on the sheet bundle PB with a driving force caused by rotation of the drive motor M1.

The sheet bundle sensor 113 is configured to have a mechanical switch whose contact is connected when the sheet bundle PB is inserted.

In a case where the sheet bundle PB is inserted into the sheet bundle insertion unit 111 and the mechanical switch of the sheet bundle sensor 113 is in a closed state (sheet bundle is present), the mechanical switch of the sheet bundle sensor 113 remains connected and the sheet bundle detection circuit 126 turns ON the power supply IC 125 so that the switching of the step-up transformer 123 is initiated, power is supplied from the second power supply 120 to the drive motor M1, and the stapling is performed.

Then, it is determined whether the stapling is completed or not (S15), and the power supply IC 125 is turned OFF at the point of time (S15: Yes) when the stapling is completed after the elapse of the execution time (for example, 500 ms) of the one session of stapling and the switching of the step-up transformer 123 by the power supply IC 125 is stopped.

Accordingly, in a case where the stapling is not performed, the power supply IC 125 is turned OFF and the switching of the step-up transformer 123 by the power supply IC 125 is stopped, and thus switching loss is not generated and standby power of the second power supply 120 may be remarkably reduced.

Also, power required for the stapling is supplied only from the second power supply 120, and power required for an image forming operation of the image forming apparatus 1 is supplied from the power supply device 14. In other words, since the dedicated second power supply 120 is provided, the required stapling and image forming operation are performed independently of each other, and each of the stapling and the operation is not limited.

Even in a case where the stapling device 100 is a so-called optional device, that is, mounting thereof is selected before the image forming apparatus 1 is shipped out of a factory, the power to the drive motor M1 driving the stapling unit 112 is supplied by the second power supply 120 of the stapling device 100.

Also, the stapling of the stapling device 100 is performed when the power is supplied from the second power supply 120 to the drive motor M1 via the sheet bundle sensor 113 and the sheet bundle detection circuit 126 of the stapling device 100.

Accordingly, there is no need to alter the configuration of or add a function to the image forming apparatus control unit 11 and the power supply device 14 of the image forming apparatus 1 by mounting the stapling device 100, and thus manufacturing costs are not increased.

Figure 6:
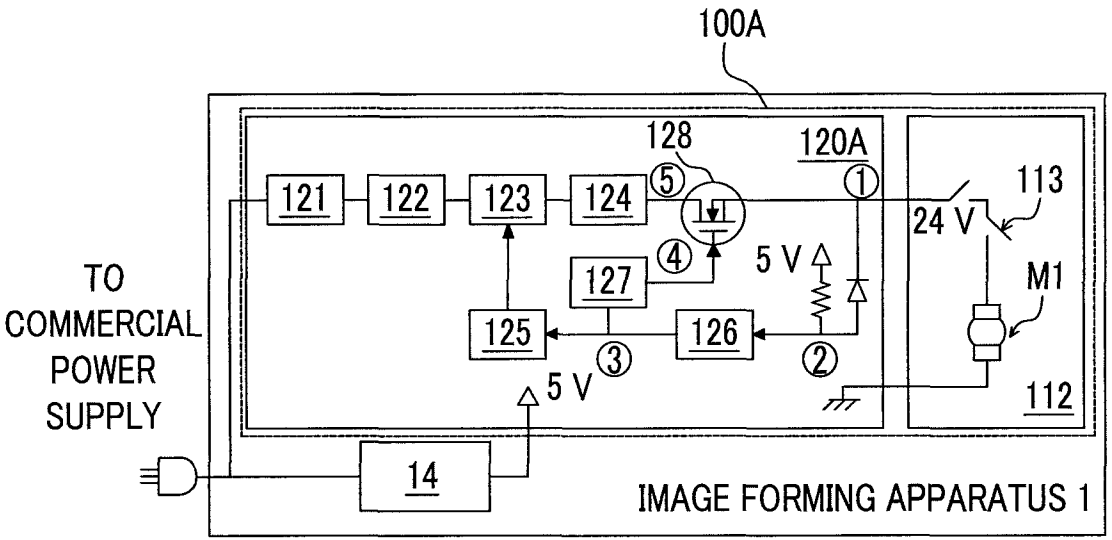
FIG. 6 is a block diagram of a stapling device that has a second power supply according to a second exemplary embodiment.
Figure 7:
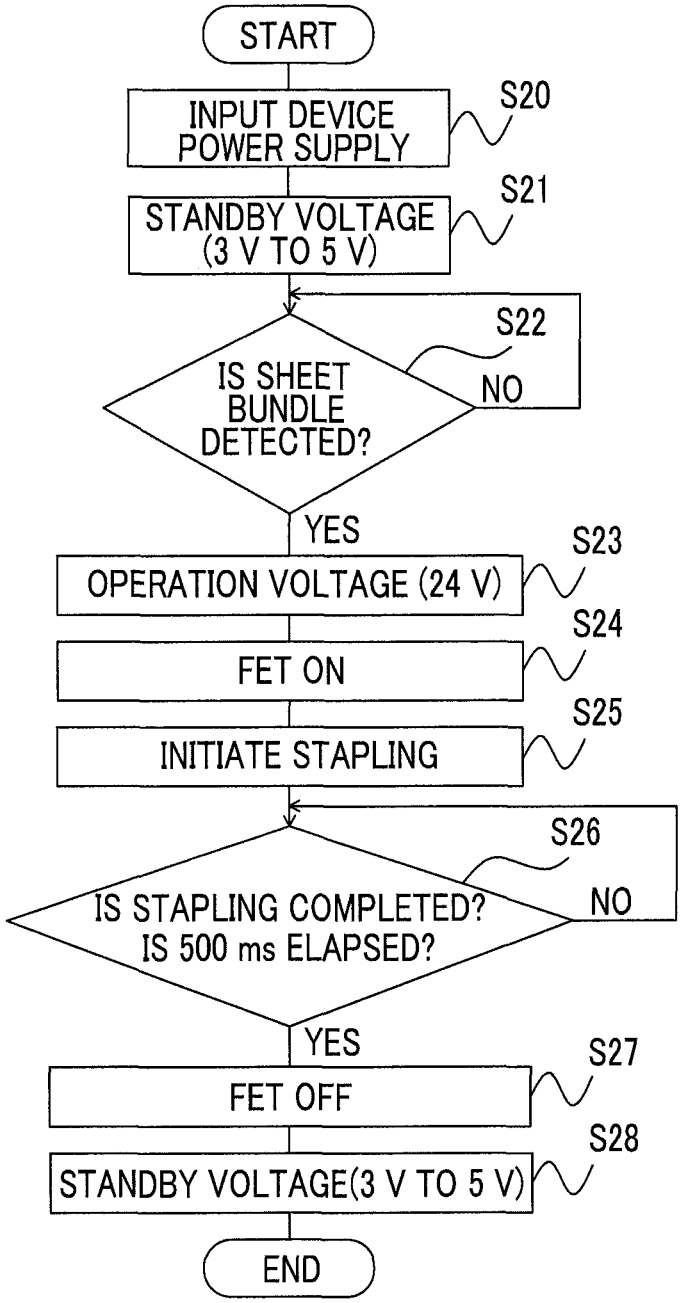
FIG. 7 is a flowchart showing a flow of operation of stapling of the stapling device according to the second exemplary embodiment.
Figure 8:
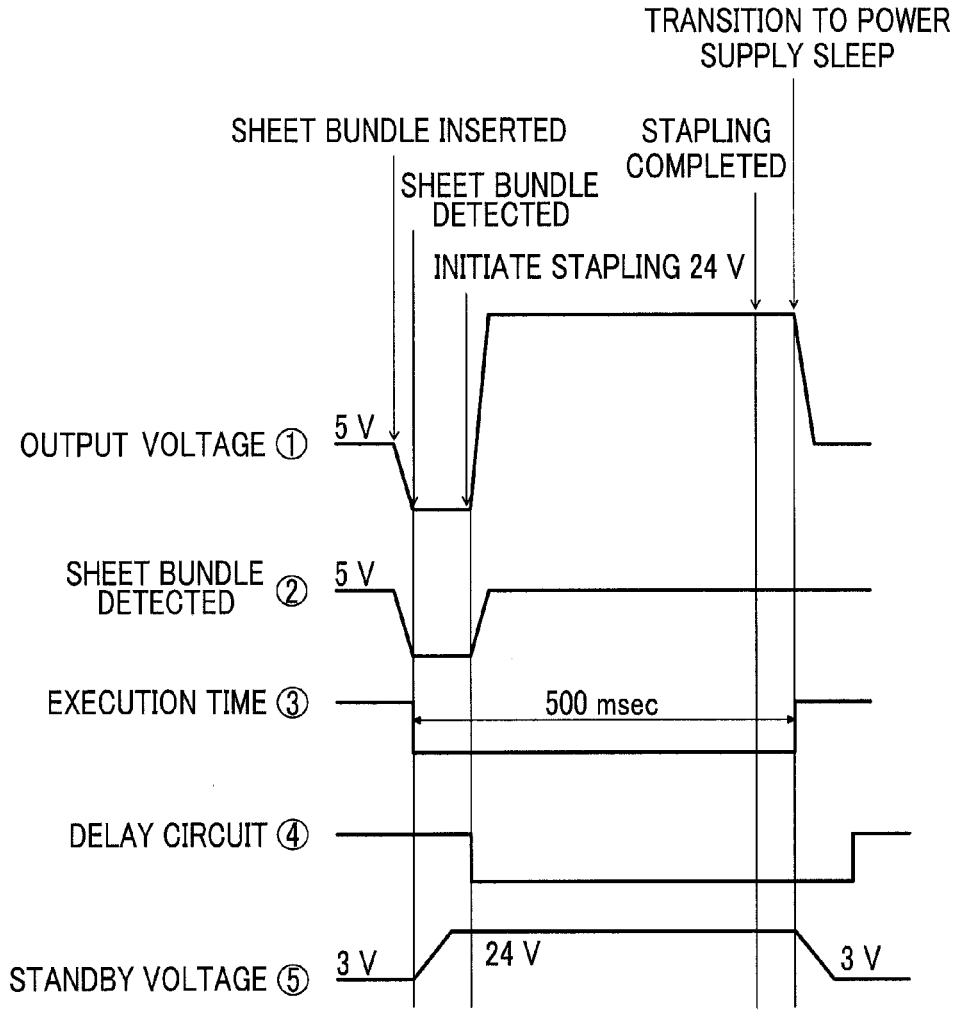
FIG. 8 is a time chart illustrating a change in voltage in the second power supply according to the second exemplary embodiment.

Second Exemplary Embodiment (1) Block Configuration and Operation of Stapling Device 100A FIG. 6 is a block diagram of a stapling device 100A that has a second power supply 120A according to this exemplary embodiment. FIG. 7 is a flowchart showing a flow of operation of stapling of the stapling device 100A. FIG. 8 is a time chart illustrating a change in voltage in the second power supply 120A.

The stapling device 100A according to this exemplary embodiment is different from the stapling device 100 according to the first exemplary embodiment in that the stapling device 100A reduces standby power in a standby state by maintaining voltage within a range where the drive motor M1 is not operated and performs stapling by boosting power supply voltage up to operation voltage of the drive motor M1 after the sheet bundle PB is detected by the sheet bundle sensor 113.

As such, in the following description, the same reference numerals will be assigned to the same elements as in the first exemplary embodiment and detailed description thereof will be omitted.

As shown in FIG. 6, the dedicated second power supply 120A is configured to have the filter 121, the primary side smoothing circuit 122, the step-up transformer 123, the secondary side smoothing circuit 124, the power supply IC 125, the sheet bundle detection circuit 126, a delay circuit 127, and an FET 128.

The second power supply 120A maintains the power supply voltage between 3 V and 5 V through intermittent oscillation of the power supply IC 125 while the FET 128 stands by in an OFF state (S21).

Next, in a case where the sheet bundle PB is inserted into the sheet bundle insertion unit 111 and the sheet bundle sensor 113 is ON (sheet bundle is present) (S22: Yes), the sheet bundle detection circuit 126 turns ON the power supply IC 125 which is the switching element, and the switching of the step-up transformer 123 is initiated.

When the switching of the step-up transformer 123 is initiated by the power supply IC 125, the alternating current boosted by the step-up transformer 123 is in a state (S23) of being output to the drive motor M1 via the secondary side smoothing circuit 124 as 24 V which is drive voltage, and thus the FET 128 is turned ON (S24) and the stapling is performed on the sheet bundle PB (S25).

Then, it is determined whether the stapling is completed or not (S26), and the FET 128 is turned OFF (S27) at the point of time (S26: Yes) when the stapling is completed after the elapse of the execution time (for example, 500 ms) of the one session of stapling stored in the stapling time storage unit so that the drive motor M1 is not operated, and stands by (S28) in a state where the power supply voltage is maintained between 3 V and 5 V through the intermittent oscillation of the power supply IC 125.

(2) Operation and Effect of Stapling Device 100A

The stapling device 100A according to this exemplary embodiment maintains voltage (for example, 3 V) within a range where the drive motor M1 is not operated in a standby state and boosts the power supply voltage up to the operation voltage (24V) of the drive motor M1 after the sheet bundle PB is detected by the sheet bundle sensor 113, and the FET 128 is turned ON (S25) and the stapling of the sheet bundle PB is performed.

Also, after the stapling is completed, the power supply voltage is maintained between 3 V and 5 V through the intermittent oscillation of the power supply IC 125 and the FET 128 is turned OFF to be in a standby state so that the drive motor M1 is not operated.

In other words, since the dedicated second power supply 120A is provided, the voltage is lowered and maintained at the voltage (for example, 3 V to 5 V) within the range where the drive motor M1 is not operated in the standby state where the stapling is not performed, and thus the switching loss of the power supply IC 125 may be suppressed and standby power of the second power supply 120A may be reduced.

Also, in the standby state, the FET 128 is turned OFF and output of the power supply voltage is blocked, and thus a misoperation of the stapling unit 112 may be prevented.

As shown in FIG. 8, when the sheet bundle PB is detected by the sheet bundle sensor 113, the power supply voltage is increased from standby voltage (3 V) up to the operation voltage (24 V) of the drive motor M1 and the FET 128 is turned ON, and thus rise of the drive motor M1 up to the drive voltage is fast and a start-up failure of the drive motor M1 may be suppressed.

Further, time is shortened between the insertion of the sheet bundle PB by a user and the initiation of the stapling, and the user does not feel uncomfortable.

Third Exemplary Embodiment

(1) Block Configuration and Operation of Stapling Device 100B

Figure 9:
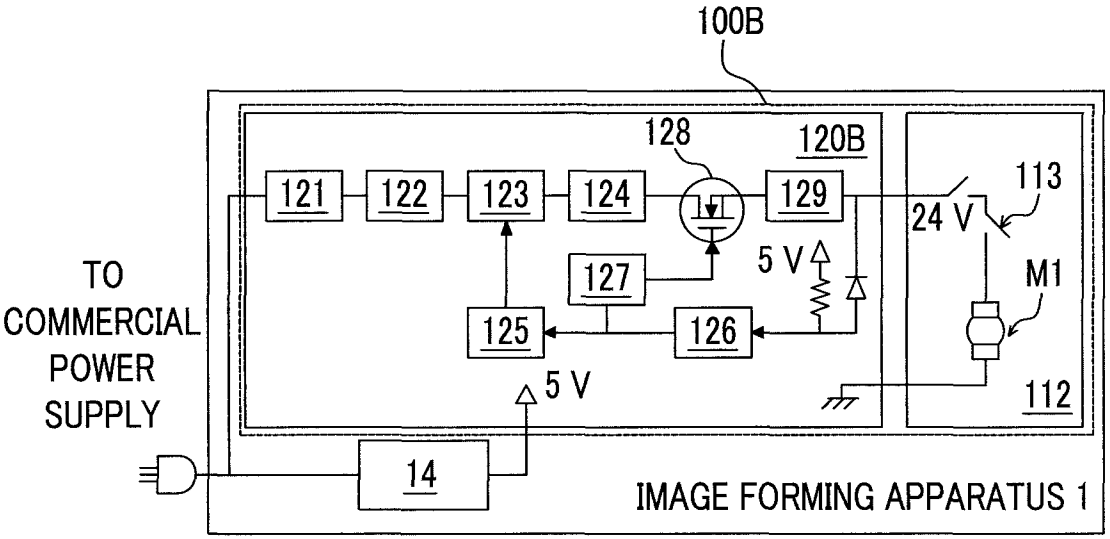
FIG. 9 is a block diagram of a stapling device that has a second power supply according to a third exemplary embodiment.
Figure 10:
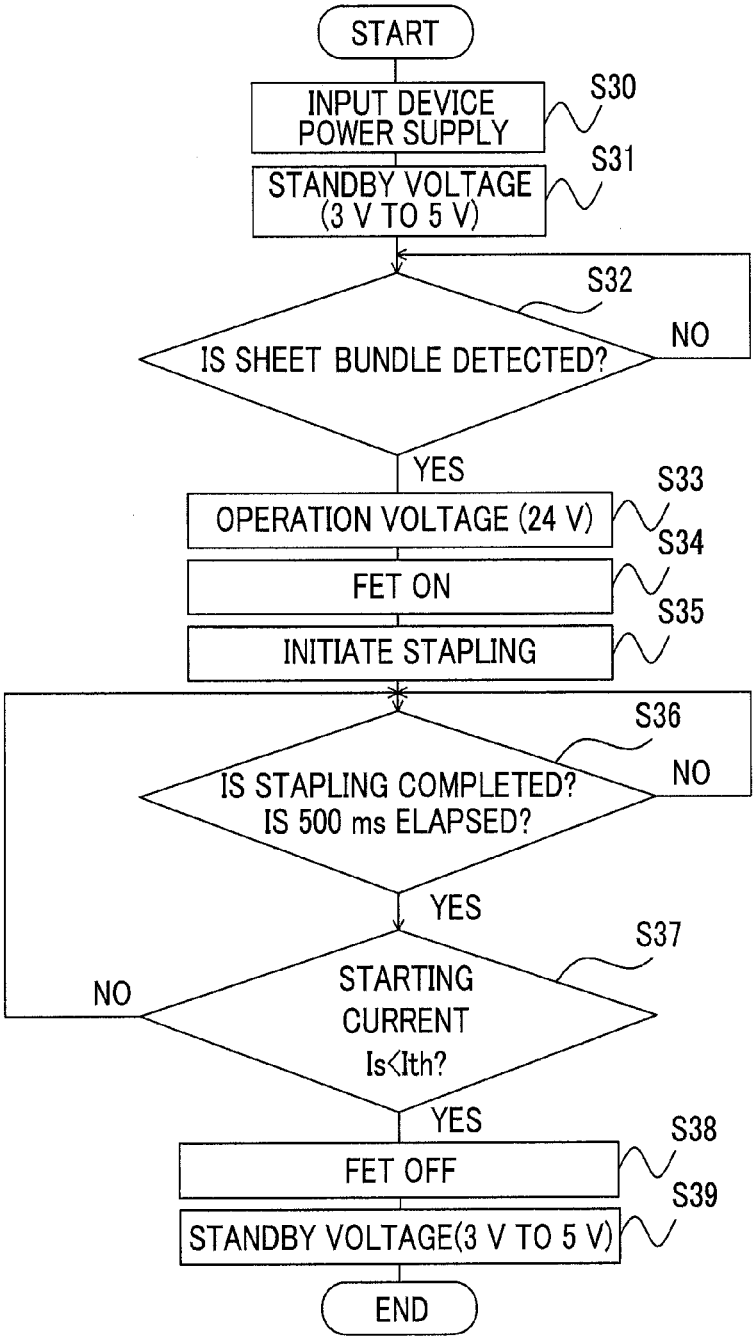
FIG. 10 is a flowchart showing a flow of operation of stapling of the stapling device according to the third exemplary embodiment.
Figure 11A:
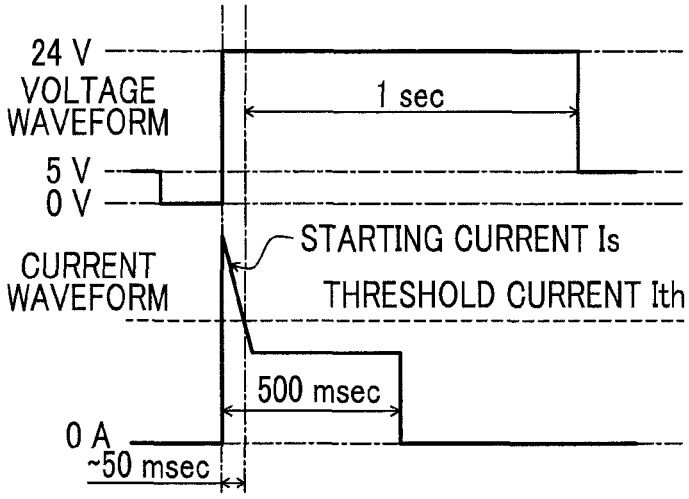
FIG. 11A is a schematic diagram of a voltage waveform and a current waveform of the second power supply during one session of stapling.
Figure 11B:
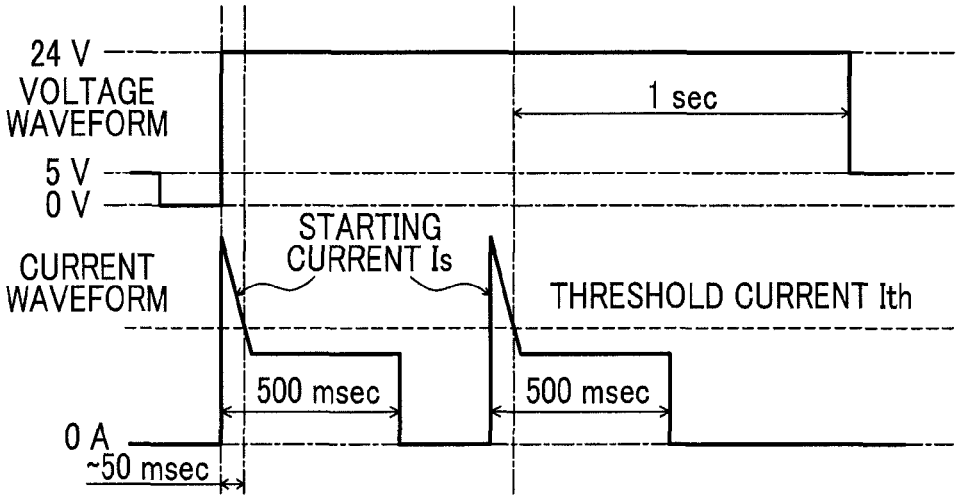
FIG. 11B is a schematic diagram of a voltage waveform and a current waveform of the second power supply during a continuous stapling.

FIG. 9 is a block diagram of a stapling device 100B that has a second power supply 120B according to this exemplary embodiment. FIG. 10 is a flowchart showing a flow of operation of stapling of the stapling device 100B. FIG. 11A is a schematic diagram of a voltage waveform and a current waveform of the second power supply 120B during one session of stapling, and FIG. 11B is a schematic diagram of a voltage waveform and a current waveform of the second power supply 120B during a continuous stapling.

The stapling device 100B according to this exemplary embodiment is different from the stapling device 100 according to the first exemplary embodiment and the stapling device 100A according to the second exemplary embodiment in that the dedicated second power supply 120B has a current detection circuit 129, detects a starting current value during the stapling, and the output of the power supply voltage is maintained for a predetermined time based on a difference between the detected starting current (Is) and a predetermined threshold current (Ith).

As such, in the following description, the same reference numerals will be assigned to the same elements as in the first exemplary embodiment and the second exemplary embodiment and detailed description thereof will be omitted.

As shown in FIG. 8, the second power supply 120B is configured to have the filter 121, the primary side smoothing circuit 122, the step-up transformer 123, the secondary side smoothing circuit 124, the power supply IC 125, the sheet bundle detection circuit 126, the delay circuit 127, the FET 128, and the current detection circuit 129.

The second power supply 120B maintains the power supply voltage between 3 V and 5 V through intermittent oscillation of the power supply IC 125 while the FET 128 stands by in an OFF state (S31).

Next, in a case where the sheet bundle PB is inserted into the sheet bundle insertion unit 111 and the sheet bundle sensor 113 is ON (sheet bundle is present) (S32: Yes), the sheet bundle detection circuit 126 turns ON the power supply IC 125 which is the switching element, and the switching of the step-up transformer 123 is initiated.

When the switching of the step-up transformer 123 is initiated by the power supply IC 125, the alternating current boosted by the step-up transformer 123 is in a state (S33) of being output to the drive motor M1 via the secondary side smoothing circuit 124 as 24 V which is drive voltage, and thus the FET 128 is turned ON (S34) and the stapling is performed on the sheet bundle PB (S35).

Then, it is determined whether the stapling is completed or not (S36), and the starting current Is is detected and it is determined whether the starting current Is exceeds the predetermined threshold current (Ith) or not (S37) at the point of time (S36: Yes) when the stapling is completed after the elapse of the execution time (for example, 500 ms) of the one session of stapling stored in the stapling time storage unit.

As a result, in a case where the detected starting current Is exceeds the predetermined threshold current (Ith) (S37: No), the FET 128 is in an ON state (S35), and it is determined again whether the stapling is completed or not (S36).

In a case where the detected starting current Is does not exceed the predetermined threshold current (Ith) (S37: Yes), the FET 128 is turned OFF (S38) so that the drive motor M1 is not operated, and stands by (S39) in a state where the power supply voltage is maintained between 3 V and 5 V through the intermittent oscillation of the power supply IC 125.

(2) Operation and Effect of Stapling Device 100B

In the stapling device 100B according to this exemplary embodiment, the second power supply 120B has the current detection circuit 129, detects the starting current (Is) during the stapling, and maintains the output (24 V) of the power supply voltage for a predetermined time (1 sec in FIGS. 11A and 11B) based on the difference between the detected starting current (Is) and the predetermined threshold current (Ith).

Accordingly, the starting current (Is) is detected via the current detection circuit 129 and the output (24 V) of the power supply voltage is maintained even in a case where the stapling is completed first and then the sheet bundle PB is inserted into the sheet bundle insertion unit 111 for next stapling within the execution time (for example, 500 ms) of the one session of stapling stored in the stapling time storage unit.

As a result, there is no possibility that the power supply voltage is blocked during the next stapling and the operation of the drive motor M1 is discontinued.

The voltage is lowered and maintained at the voltage (for example, 3 V to 5 V) within the range where the drive motor M1 is not operated in the standby state, and thus the switching loss of the power supply IC 125 may be suppressed and standby power of the second power supply 120B may be reduced.

Also, the FET 128 is turned OFF in the standby state and the output of the power supply voltage is blocked, and thus a misoperation of the stapling unit 112 may be prevented.

Hereinabove, specific examples of the exemplary embodiments of the present invention have been described, but the scope of the present invention is not limited to the above-described exemplary embodiments and various modifications can be made without departing from the scope of the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing device comprising:

a stapling unit that performs stapling on a sheet bundle with a driving force caused by a rotation of a motor;

a power supply unit that supplies power only to the motor;

a sheet bundle detector that detects presence or absence of the sheet bundle which is inserted into the stapling unit; and a stapling time storage unit that stores an execution time of one session of the stapling, wherein the power supply unit maintains a first output voltage that is predetermined and is required for an operation of the motor and a second output voltage that is lower than the first output voltage in such a manner as to be selectable via a switching element, outputs the first output voltage to the motor based on a detection result of the sheet bundle detector, maintains the second output voltage after an elapse of a predetermined time which is stored in the stapling time storage unit, and stops supplying the power to the motor.

2. An image forming apparatus comprising:

an image recording unit that records an image on a medium; and the post-processing device according to claim 1.

3. The post-processing device according to claim 1, wherein the predetermined time is about 500 ms.

4. A post-processing device comprising:

a stapling unit that performs stapling on a sheet bundle with a driving force caused by a rotation of a motor;

a power supply unit that includes a current detector and supplies power only to the motor;

a sheet bundle detector that detects a presence or absence of the sheet bundle which is inserted into the stapling unit; and a stapling time storage unit that stores an execution time of one session of the stapling, wherein the power supply unit maintains a first output voltage that is predetermined and is required for an operation of the motor and a second output voltage that is lower than the first output voltage in such a manner as to be selectable via a switching element, and maintains the first output voltage in a case where a current value detected by the current detector exceeds a predetermined current value within a predetermined time stored in the stapling time storage unit.

5. An image forming apparatus comprising:

an image recording unit that records an image on a medium; and the post-processing device according to claim 4.

6. The post-processing device according to claim 4, wherein the predetermined time is about 500 ms.

* * * * *